US005679438A

United States Patent [19]

Ramdin et al.

[11] Patent Number: 5,679,438

[45] Date of Patent: Oct. 21, 1997

[54] FABRICS WITH A NEW WRINKLE AND A STITCH

[75] Inventors: Clement Ramdin, Concord, N.C.; Glenda Kirby, Cheshire, Conn.

[73] Assignee: Lanscot-Arlen Fabrics, Inc., Concord, N.C.

[21] Appl. No.: 849,216

[22] Filed: Mar. 10, 1992

Related U.S. Application Data

[63] Continuation-in-part of Ser. No. 512,993, Apr. 23, 1990, Pat. No. 5,094,664.

[51] Int. Cl.[6] ..... D06J 1/00

[52] U.S. Cl. ..... 428/152; 428/102; 428/103; 428/104; 428/225; 428/288; 428/245; 428/280; 428/296; 428/480; 428/475.5; 428/500; 428/532; 428/196; 428/195; 428/200; 428/913; 26/69 R; 26/69 C; 26/11; 26/16; 26/15 R; 26/27; 26/29 R; 28/163; 28/165; 28/167

[58] Field of Search ..... 428/152, 102, 428/103, 104, 725, 288, 245, 280, 296, 480, 475.5, 500, 532, 196, 195, 200, 913; 26/69 R, 69 C, 11, 16, 15 R, 27, 29 R; 112/427, 132; 28/163, 165, 167; D5/56

[56] References Cited

U.S. PATENT DOCUMENTS

| | | | |
|---|---|---|---|
| 1,744,829 | 1/1930 | Dreyfus | 26/69 R |
| 1,925,146 | 9/1933 | Loeb | 112/427 |
| 2,037,539 | 4/1936 | Robinson et al. | 428/152 |
| 2,162,591 | 6/1939 | Schneider et al. | 428/104 |
| 2,167,819 | 8/1939 | Welti | 26/69 R |
| 2,373,194 | 4/1945 | Luttge | 428/152 |
| 2,565,491 | 8/1951 | Francis, Jr. | 428/152 |
| 2,763,568 | 9/1956 | McBride | 428/152 |
| 2,777,186 | 1/1957 | Vonaesch | 26/69 R |
| 2,912,345 | 11/1959 | Weiss | 428/263 |
| 2,947,058 | 8/1960 | Landells et al. | 428/152 |
| 3,102,771 | 9/1963 | Neale | 8/482 |
| 3,193,844 | 7/1965 | Eng | 112/427 |
| 3,555,856 | 1/1971 | Williams et al. | 26/69 R |
| 4,140,827 | 2/1979 | Willwerth et al. | 181/137 |
| 4,303,459 | 12/1981 | Kleber | 156/227 |
| 4,421,812 | 12/1983 | Plant | 428/152 |
| 4,576,611 | 3/1986 | Pascoe, Sr. | 8/482 |
| 4,833,762 | 5/1989 | Kleber | 26/1 |
| 5,094,664 | 3/1992 | Randin et al. | 428/175 |

FOREIGN PATENT DOCUMENTS

| | | |
|---|---|---|
| 0 012 286 | 6/1980 | European Pat. Off. . |
| 0 158 777 | 10/1985 | European Pat. Off. . |

OTHER PUBLICATIONS

E.R. Trotman, "Dyeing and Chemical Technology of Textile Fibers," 6th ed. (Wiley–Interscience) 1984, p. 122.

"A Textile Terminology: Warp & Weft" Burnham, Routledge, and Kegan, Paul, 1980.

*Primary Examiner*—William Watkins

*Attorney, Agent, or Firm*—Rhodes Coats & Bennett, L.L.P.

[57] ABSTRACT

A process of decorating fabric includes the step of imparting wrinkles to the fabric oblique to the warp and weft directions and heat setting the wrinkles into the fabric. The wrinkle imparting step may include moving the fabric longitudinally and simultaneously moving portions of the fabric from side to side by frictionally engaging the fabric to an oscillating means such as an elastomeric pad or interleaved fingers and oscillating the pad or fingers from side to side. Heat setting of the fabric includes exposing the wrinkled fabric to heat at a sufficient temperature and for a sufficient duration to set the wrinkles in the fabric. Desirably, the wrinkled fabric is in contact with a transfer print paper while the fabric passes through the heat setting step to set the wrinkles and fix color on the fabric. The longitudinal movement is desirably coordinated with the side to side movement to obtain aesthetically pleasing results. The invention also includes apparatus and the product.

36 Claims, 13 Drawing Sheets

(1 of 13 Drawing(s) in Color)

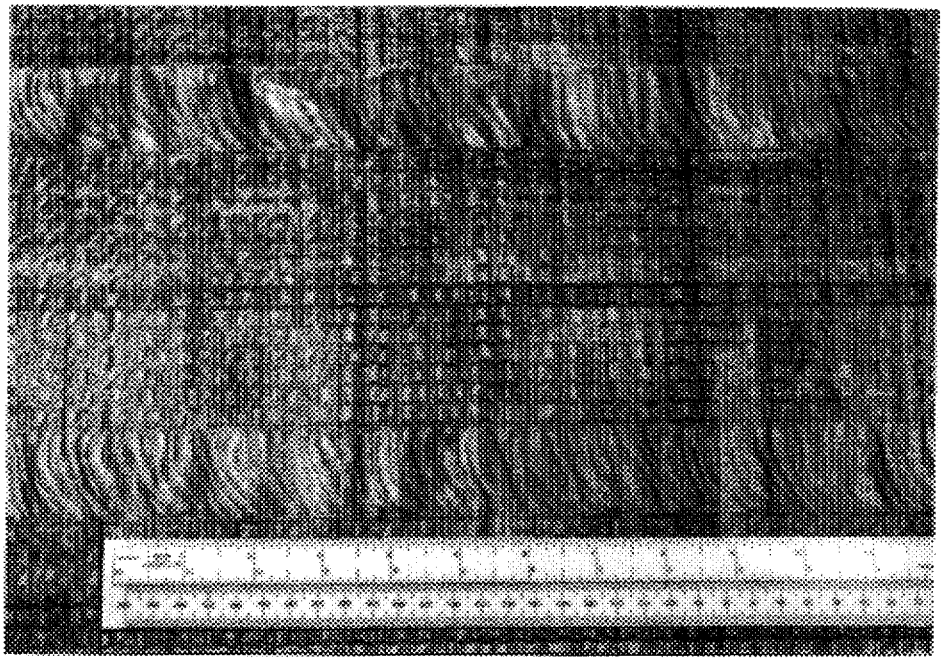
FIG. 14
FIG. 15
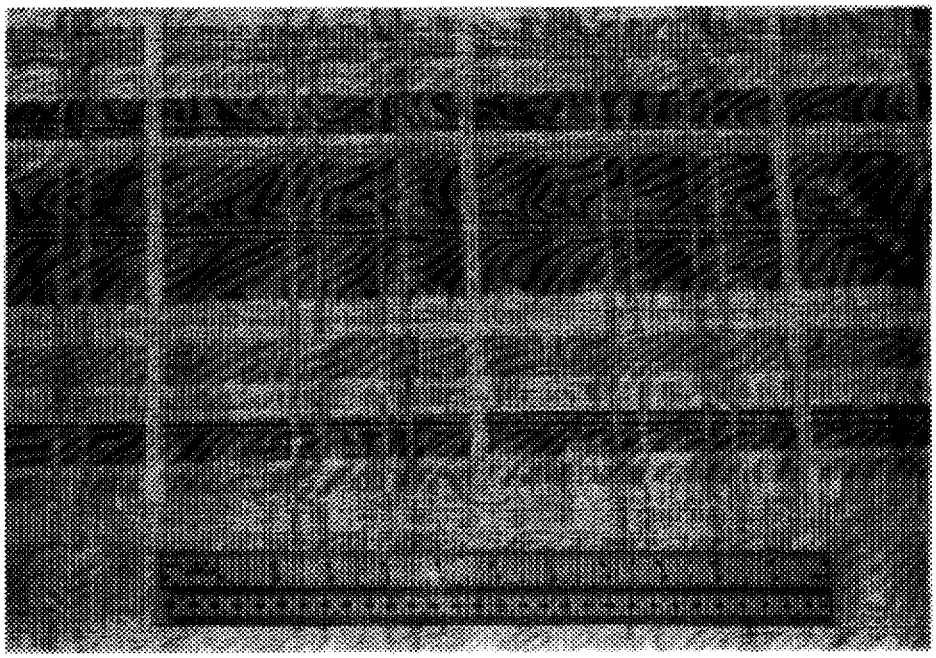

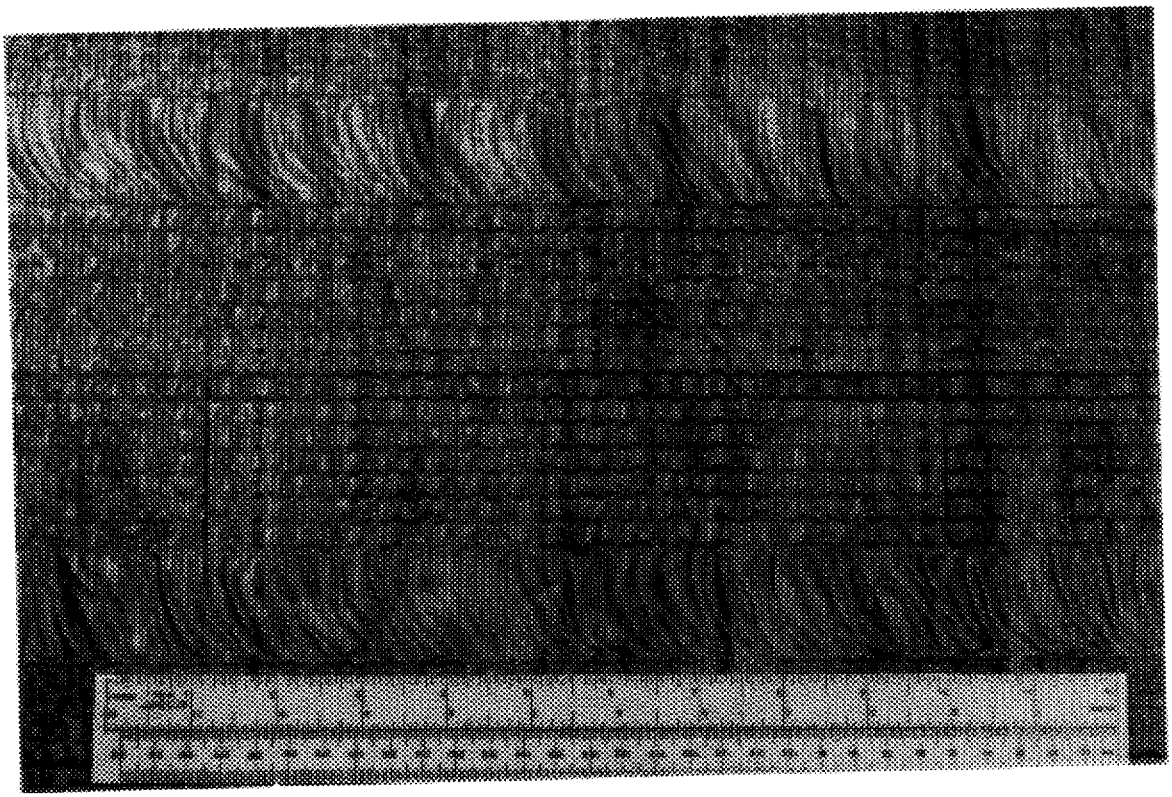
FIG. 14A
FIG. 15A
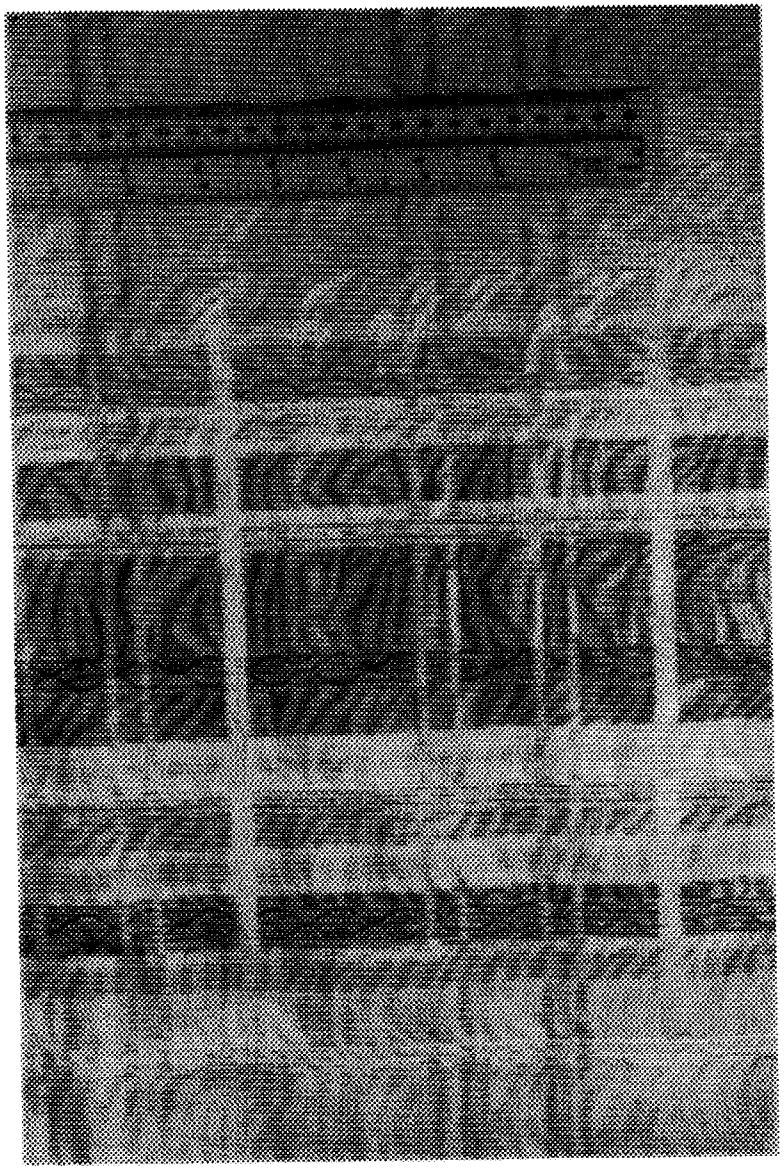

FABRICS WITH A NEW WRINKLE AND A STITCH

BACKGROUND OF THE INVENTION

This application is a continuation-in-part of our prior application Ser. No. 07/512,993 filed Apr. 23, 1990, issuing as U.S. Pat. No. 5,094,664 on Mar. 10, 1992.

The present invention relates to an improved apparatus and process for finishing fabric and the improved fabric obtained from such apparatus and process.

Various finishing processes are known for obtaining desired fabric appearances or performance properties, such as imparting permanent press properties to fabric, coloring as by dyeing, pigmenting or the like, applying various resin finishes to affect the fabric hand and heat setting to cause the warp and weft crimps of the yarns of woven fabric to obtain a memory of their woven configuration.

Often, such heat setting is accomplished simultaneously with dye fixation, especially in transfer printing. In transfer printing a fabric to be printed is fed along with a paper coated with dyestuff against a heated roll and pressed against that roll. The heat and pressure are applied to the paper and fabric for a long enough period of time (on the order of a second or two) to cause the dyestuff to be sublimated from the paper, transferred to the fabric and fixed on the fabric. Simultaneously, the heat and pressure cause the fabric to be heat set.

It is known to form pleats in fabric and heat set such pleated fabric, so that the fabric has a memory of such pleats. However, such pleats are invariably straight, parallel folds in the fabric, extending in either the warp or weft direction.

In addition, wrinkles are sometimes formed and heat set in fabrics on a random basis, but such wrinkles are undesirable, since they are not controlled and not intended. When such wrinkles are obtained, the prior art usually treats fabric having such wrinkles as second quality goods.

The art is not, however, familiar with fabrics having controlled, aesthetically pleasing wrinkles. Applicants have devised a method and apparatus for making such a fabric, so that the fabric has desirable aesthetics. In particular, the art is not familiar with such a fabric having coloration, especially such that the wrinkles and coloration interact visually to achieve a desired result. A particularly desirable result is a drape-like undulation in the wrinkles, so that when the fabric is used as a drapery fabric, the undulations correlate with the drapery undulations to form a pleasing effect.

SUMMARY OF THE INVENTION

These desirable results are obtained by providing a fabric having wrinkles heat set therein in which the wrinkles are oriented oblique to the warp and weft directions. Preferably, such a fabric has side edges and the wrinkles extend for short lengths and alternate between angles toward one side edge and the other. The wrinkles in the fabric may have a warpwise oriented undulation. A preferred fabric is chintz.

In the preferred embodiment the fabric is made of a heat settable fiber, such as a fiber selected from the group consisting of polyester, nylon, olefin, and acrylic or blends thereof, which may include cotton, wool or rayon.

In another preferred embodiment, the fabric has wrinkles therein to form portions obscured by folds and coloration on the fabric in areas other than the obscured portions. Preferably, the wrinkles are oblique to the warp and weft direction. More preferably, the fabric has two faces and the coloration is predominantly on one face. In a particular embodiment, the combination of colored and uncolored areas provide a bamboo-like look to the fabric. Desirably, the coloration is fixed onto the fabric and the coloration is a transfer print. If desired, the coloration may be a pattern. Preferably, the fabric is a woven fabric, but knits and nonwovens may also be treated.

The invention also provides a process of decorating fabric including the step of imparting wrinkles to the fabric and heat setting the wrinkles into the fabric. Preferably, the wrinkle imparting step includes moving the fabric longitudinally and simultaneously moving portions of the fabric from side to side. The step of longitudinally moving the fabric may include unrolling the fabric from a roll. The step of moving portions of the fabric from side to side may include frictionally engaging the fabric to an oscillating means and oscillating the means from side to side. Preferably in such a step, the fabric is engaged by an elastomeric pad and the elastomeric pad oscillates from side to side while the fabric moves longitudinally to impart undulatory wrinkles to the fabric.

In an alternative embodiment the step of moving portions of the fabric from side to side includes passing the fabric through a folder so that folds are formed in the fabric and the folder is moved from side to side. In this embodiment, the step of passing the fabric through a folder includes passing the fabric through an array of rods elongated predominantly in the longitudinal direction so that the fabric passes over alternate ones of the rods and under intervening ones of the rods.

Preferably, the step of heat setting the fabric includes exposing the fabric with wrinkles therein to heat at a sufficient temperature and for a sufficient duration to set the wrinkles in the fabric. Such step may include passing the fabric with wrinkles therein into contact with a roll heated to 435 degrees fahrenheit and exerting a pressure on the order of about 80 psi on the fabric against the roll.

In a particularly preferred embodiment the process includes the step of imparting coloration to the fabric. The coloration imparting step preferably includes contacting the wrinkled fabric with a transfer print paper and passing the fabric and paper through the heat setting step to set the wrinkles and fix the color on the fabric. If desired, however, the color imparting step could be performed before or after the heat setting step. Alternatively, the color imparting step may take the form of any suitable dyeing, printing or pigmenting process including doctoring colorant onto the wrinkled fabric.

Preferably the step of moving the fabric from side to side includes the step of coordinating the rate of side-to-side movement with the rate of longitudinal movement to achieve desirable aesthetic effects. This may include controlling the speed at which the fabric portion is moved to one side or the other. It may also include maintaining the fabric portion at one side for a period of time before moving towards the other side and controlling the length of such period of time.

A preferred process of decorating a heat settable fabric includes the steps of moving the fabric longitudinally through a wrinkler which imparts localized wrinkles to the fabric, simultaneously oscillating the wrinkler in a direction transverse to the direction of fabric movement to cause the wrinkles to assume an undulatory pattern, immediately thereafter contacting the wrinkled fabric with transfer print paper, and exposing the fabric and paper to heat and pressure sufficient to transfer coloration from the transfer print paper to the fabric and set the wrinkles in the fabric.

The invention also provides an apparatus for decorating fabric including means for imparting wrinkles to the fabric and a heat source for heating fabric which has had wrinkles imparted thereto to heat set the wrinkles in the fabric. In a preferred apparatus the means for imparting wrinkles includes means for passing fabric through the apparatus and means for engaging passing fabric and causing portions of passing fabric to fold onto other portions of passing fabric. In one embodiment the means for engaging includes an elastomeric pad mounted for movement transverse to the direction of fabric passage and may further include drive means for driving the pad back and forth in the transverse direction.

A preferred drive means includes a support extending over passing fabric, a plurality of linkage arms pivotally mounted on the support and pivotally connected to the pad, a pneumatic cylinder mounted on the support, a movable piston in the cylinder connected to a piston rod with a distal portion of the piston rod pivotally connected to one of the linkage arms and a pressurized air supply operatively associated with the cylinder, whereby expulsion of the piston from the cylinder by the selective application of pressurized air causes movement of the pad to one side in the transverse direction and retraction of the piston into the cylinder causes movement of the pad to the other side in the transverse direction.

Preferably, the drive means further includes an adjustable flow rate valve operatively associated with the cylinder and the pressurized air supply whereby the rate of application of air to the cylinder may be controlled to control the rate of expulsion or retraction of the piston in the cylinder and thereby control the speed of movement of the pad in the transverse direction.

More preferably, the drive means further includes control means operatively associated with the air supply to delay the supply of air to the cylinder for a selectively predetermined period. The control means may include a programmable controller having input selectors by which a delay period may be selected by an operator and a solenoid controlled air valve operatively associated with the programmable controller and the air supply so that upon expiration of a selected delay period, the programmable controller actuates the solenoid controlled air valve to supply air from the air supply to the cylinder. Desirably, the drive means further includes a limit switch on the support operatively associated with the control means for sensing completion of transverse movement of the pad and applying a signal indicative of such completion to the control means to terminate the supply of air to the cylinder.

In another aspect the means for engaging includes a frame, a beam supported on the frame and extending over a bearing surface along the path of passing fabric, a clamp supported for side to side movement by the beam, a pad clamped by the clamp and extending a majority of the width of the fabric bearing against the bearing surface such that fabric may pass between the pad and the bearing surface, and oscillation means to cause the clamp to oscillate from side to side when fabric passes between the pad and the bearing surface, whereby friction between the pad and the fabric imparts wrinkles to the fabric as it passes. Preferably, the pad includes upper and lower elongated strips of elastomeric material, the upper strip being clamped along substantially its entire length and the lower strip being clamped substantially only at its ends.

In another embodiment the means for engaging includes a base mounted for oscillation in a direction transverse to the direction of fabric passage and interleaved fingers supported on the base and extending generally in the direction of fabric passage. The fingers include an upper set of fingers downwardly extending from an upper brace on the base and a lower set of fingers upwardly extending from a lower brace. Preferably, portions of the upper fingers extending in the direction of fabric passage are at a lower elevation than portions of the lower fingers extending in the direction of fabric passage. Preferably, the fingers of one of the sets of fingers extend parallel to the direction of fabric passage and the fingers of the other set of fingers extend at an acute angle to the direction of fabric passage. A preferred acute angle is about seven degrees. Desirably, alternating ones of the fingers of the second set extend at acute angles to the left and intervening ones of the fingers extend at acute angles to the right.

The invention further provides a fabric having wrinkles heat set therein in which the wrinkles are oriented oblique to the warp and weft directions and have a weftwise oriented undulation. In a preferred embodiment the fabric has a plurality of stitched portions and the wrinkles extend from one stitched portion to another.

Preferably the fabric is chintz, but the invention includes fabrics of any heat settable fiber. For example, the fabric may be made of a fiber selected from the group consisting of polyester, nylon, olefin, and acrylic or blends thereof.

The invention further provides a fabric having wrinkles therein and areas between the wrinkles and coloration on the fabric extending across the wrinkles, with the wrinkles having coloration of a deeper hue than the areas of the fabric between the wrinkles. Preferably, the fabric has a plurality of stitched portions and the wrinkles extend from one stitched portion to another. Desirably, the stitching is provided in a pattern. Typically, the wrinkles have a coloration of a deeper hue than the areas of the fabric between the wrinkles and the stitching and the wrinkles combine to form a pattern on the fabric different from the stitched or colored patterns alone. Typically, the coloration is provided in a pattern, and the deeper hue of color in the wrinkles and stitching modifies the pattern.

Preferably, the fabric is chintz. Usually, the fabric is made of a heat settable fiber. Typically, the wrinkles are oblique to the warp and weft direction. In a preferred embodiment, the fabric has two faces and the coloration is predominantly on one face. In a preferred embodiment, the coloration is a transfer print. Typically, the fabric is woven.

The invention further provides a method of decorating a fabric including stitching the fabric to develop wrinkles therein and heat treating the fabric to set the wrinkles. In a preferred embodiment the stitching step includes stitching the fabric with a stitching machine while overfeeding fabric to the machine. It is also preferred that the heat treating step take the form of transfer printing the fabric. Preferably, the transfer printing step includes transfer printing a pattern of coloration, and the wrinkles pick up the coloration unevenly to modify the printed pattern. If desired, the fabric may be dyed before stitching.

BRIEF DESCRIPTION OF THE DRAWINGS

The file of this patent contains at least one drawing executed in color. Copies of this patent with color drawings will be provided by the Patent and Trademark Office upon request and payment of the necessary fee.

The invention will be better understood after reading the Detailed Description of the Preferred Embodiments hereinafter along with a study of the drawings in which:

FIGS. 14 and 14A are black-and-white and color photographs of a multi-color wrinkled fabric according to another embodiment of the invention; and FIGS. 15 and 15A are black-and-white and color photographs of a multi-color wrinkled fabric according to a further embodiment of the invention.

DETAILED DESCRIPTION OF THE PREFERRED EMBODIMENTS

Figure 1:
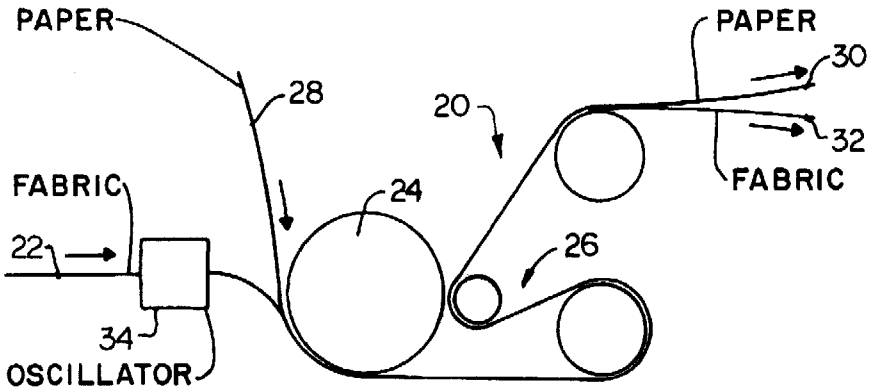
FIG. 1 is a side schematic view of a transfer printing apparatus modified to include a wrinkler according to the invention.

FIG. 1 shows schematically a conventional transfer printing apparatus 20 which has been modified in accordance with the present invention. In transfer printing, a fabric from a fabric supply 22, typically a roll of fabric (or perhaps fabric fed from a J-box) is fed with a transfer print paper 28 from a paper roll into contact with a heated roll 24 under tension applied by tension rolls 26. The effect of the tension on the fabric is to compress the fabric 22 and paper 28 against the roll 24, which causes the dye on the paper to be transferred and fixed on the fabric. The fabric speed, roll temperature and tension needed for transfer printing are all well known to those of ordinary skill in the art. A typical fabric speed is 450–500 meters/hour, with a typical roll temperature of 435 degrees fahrenheit and 80 pounds per square inch (psi) pressure on the fabric 22 against the roll 24. It has been found, however, that in practicing the present invention a speed of 300 meters/hour is preferred. The printed fabric is taken up on a roll at 32, and the paper is taken up on a separate roll at 30. The means for passing the fabric and paper through the apparatus may be any of the suitable mechanisms very well known to those of ordinary skill in the art. The conventional apparatus has been modified by the addition of a wrinkler 34 which imparts wrinkles to the fabric 22 before contacting the paper 28 or roll 24.

Figure 2:
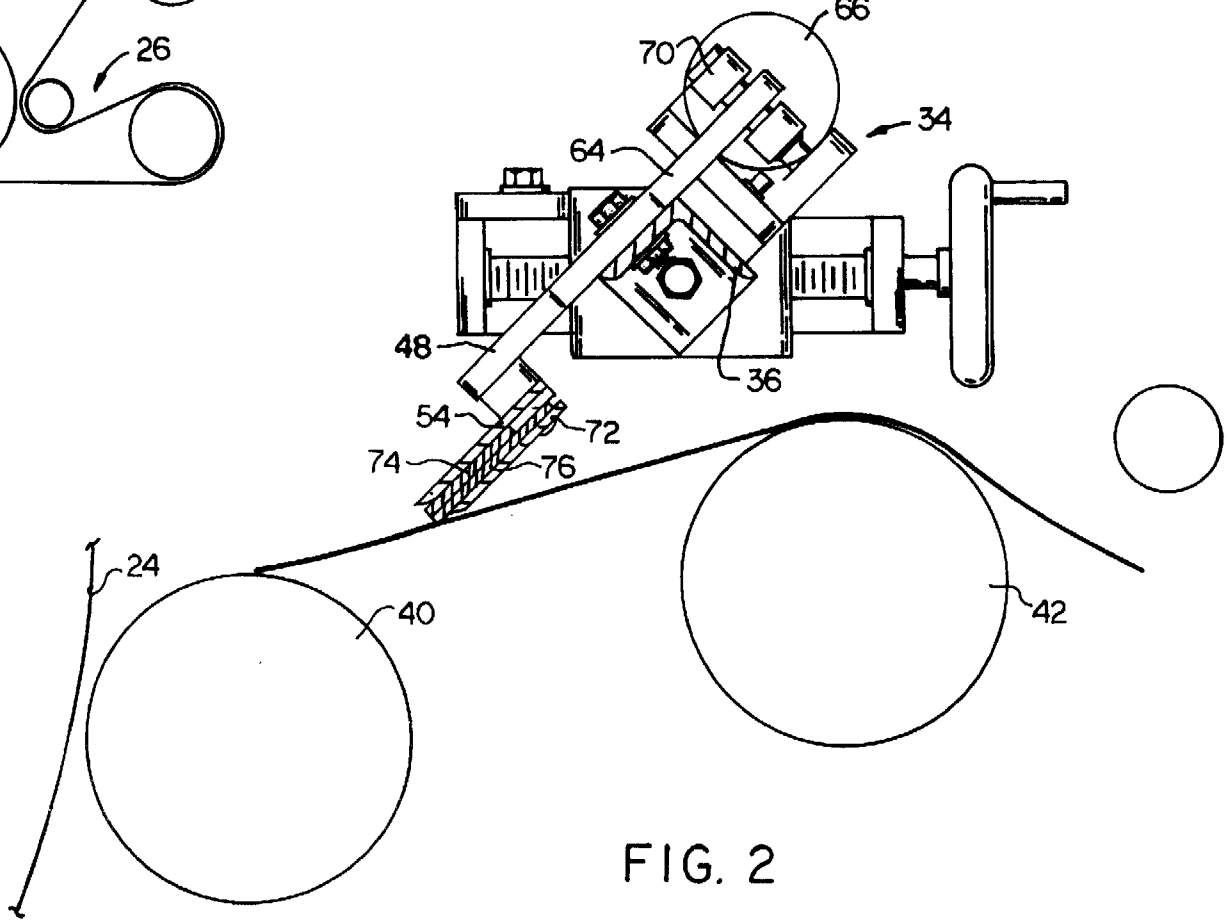
FIG. 2 is a side elevation view of a wrinkler according to one embodiment of the invention.
Figure 3A:
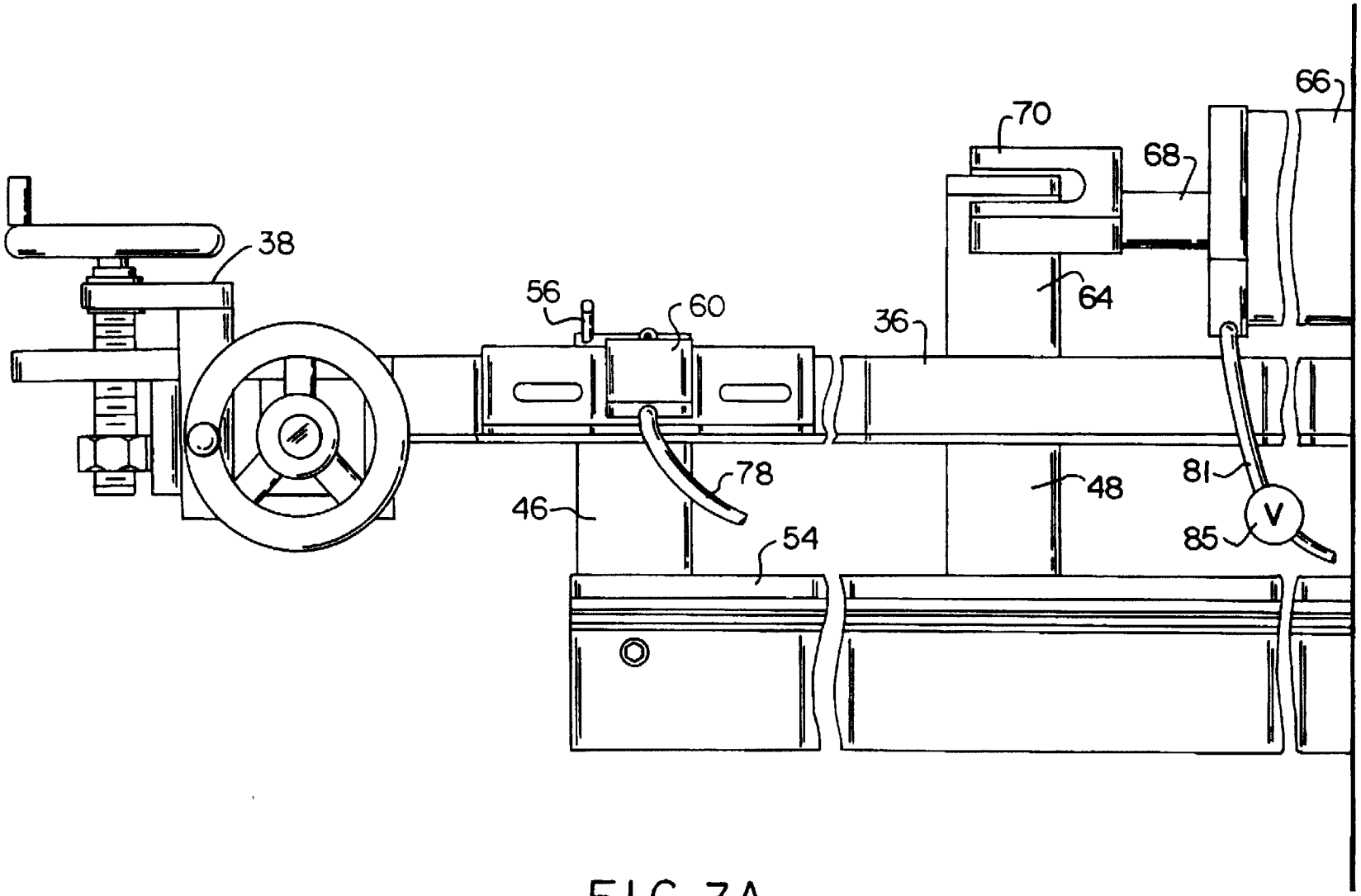
FIGS. 3A and 3B may be joined at the matchline to form a plan view of the wrinkler of FIG. 2.
Figure 3B:
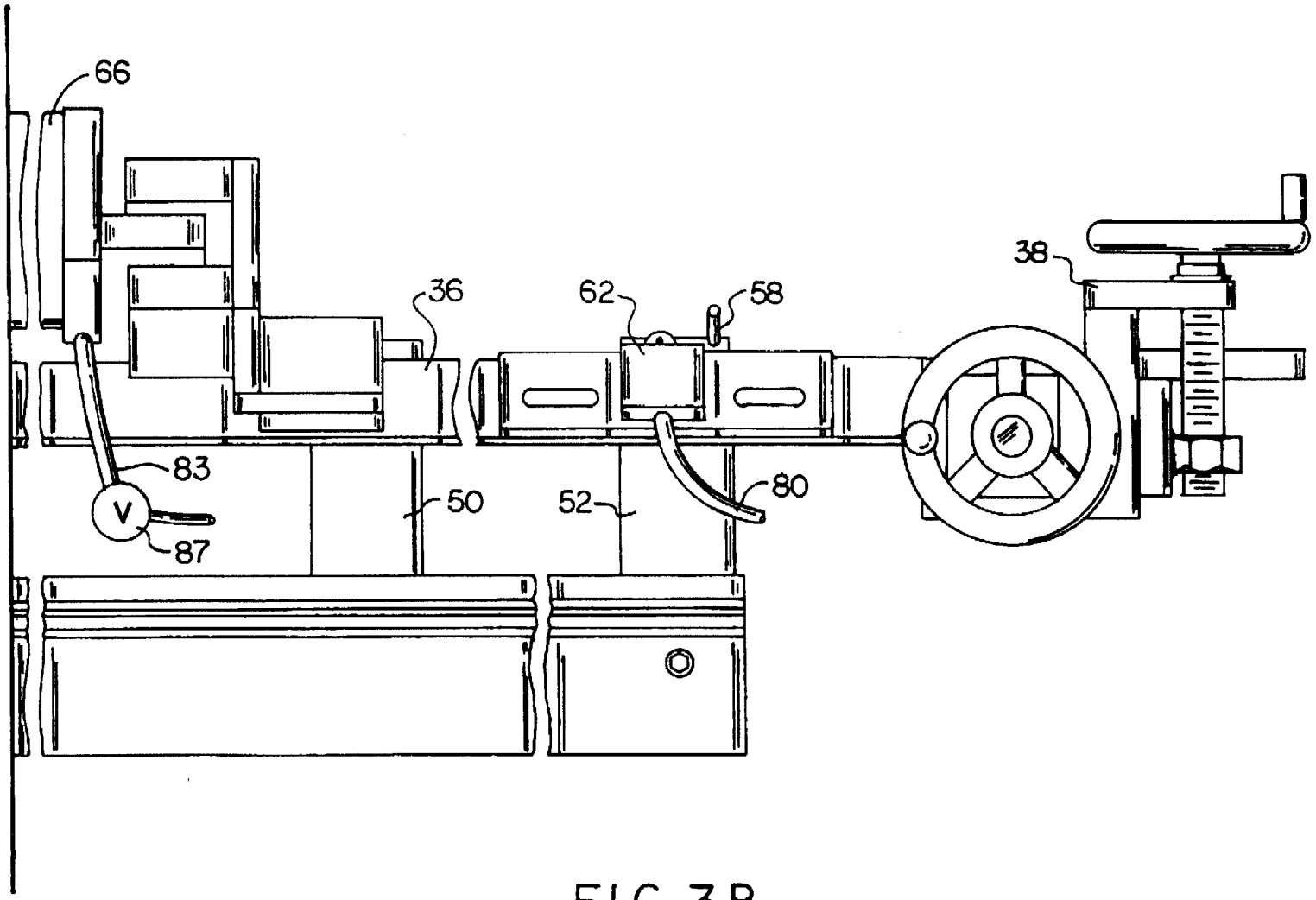

FIGS. 2 and 3 illustrate one embodiment of a suitable wrinkler 34. The wrinkler 34 includes a bar 36 which spans the housing of the transfer printing apparatus (not shown). The bar 36 is adjustably mounted on the apparatus by height and skew adjustments 38, shown in more detail in FIGS. 4 and 5 and further discussed hereinafter. A curved plate of metal 44 is situated below the bar 36, serving mainly to shield rolls 40 and 42 from damage.

Pivotally mounted on bar 36 are a plurality of arms 46, 48, 50, 52. Each of arms 46, 48, 50, and 52 is also pivotally linked to a movable bar 54, so that the arms 46–52 together with bar 36 and movable bar 54 form a parallelogram linkage. In the parallelogram linkage pivotal movement of one of the arms 46–52 about its pivot point with bar 36 causes pivoting at the connection of that arm with the movable bar 54, movement of the bar 54 in the direction of its length and corresponding pivoting of the other arms with the bars 36 and 54. An intermediate arm 48 has an upper length 64 extending above bar 36. A pneumatic cylinder 66 is pivotally mounted on bar 36, with its piston rod 68 connected via clevis 70 to the upper length 64. Thus, when the pneumatic cylinder 66 is actuated to push its piston rod 68 out, the upper length of arm 48 is pivoted about the pivotal mounting with bar 36 to cause the parallelogram linkage to move the movable bar 54 to the right in FIG. 3. Retraction of the piston rod into the cylinder causes movement in the opposite direction.

Each of the end-most arms 46 and 52 is provided with an upstanding dog 56, 58 located so as to trip a limit switch 60, 62, providing an indication that the respective arm is pivoted to a particular angle corresponding to an extreme right or extreme left position of the bar 54. Electrical connections 78 and 80 extend from switches 60 and 62, and air lines 81 and 83 are connected to the cylinder 66 through respective flow rate valves 85 and 87. These connections, air lines and valves will be discussed in further detail in connection with the explanation of FIG. 6 below.

As is best seen in FIG. 2, bar 54 cooperates with a similar bar 72 to bind a pair of neoprene strips 74, 76 extending along the length of bar 54. Upper strip 74 is somewhat narrower than lower strip 76, and upper strip 74 is bound to the bar 54 at multiple locations along the length of bar 54. Lower strip 76, on the other hand, is bound to the bar 54 only at its ends, giving the central portion of the strip 76 considerable freedom of movement, due to the elasticity of the neoprene material of which it is made. Of course, other materials having suitable properties could be substituted. As shown in FIG. 2, the lower strip 76 contacts plate 44, but in use, fabric being treated will pass between these strip 7 and plate 44.

Figure 4:
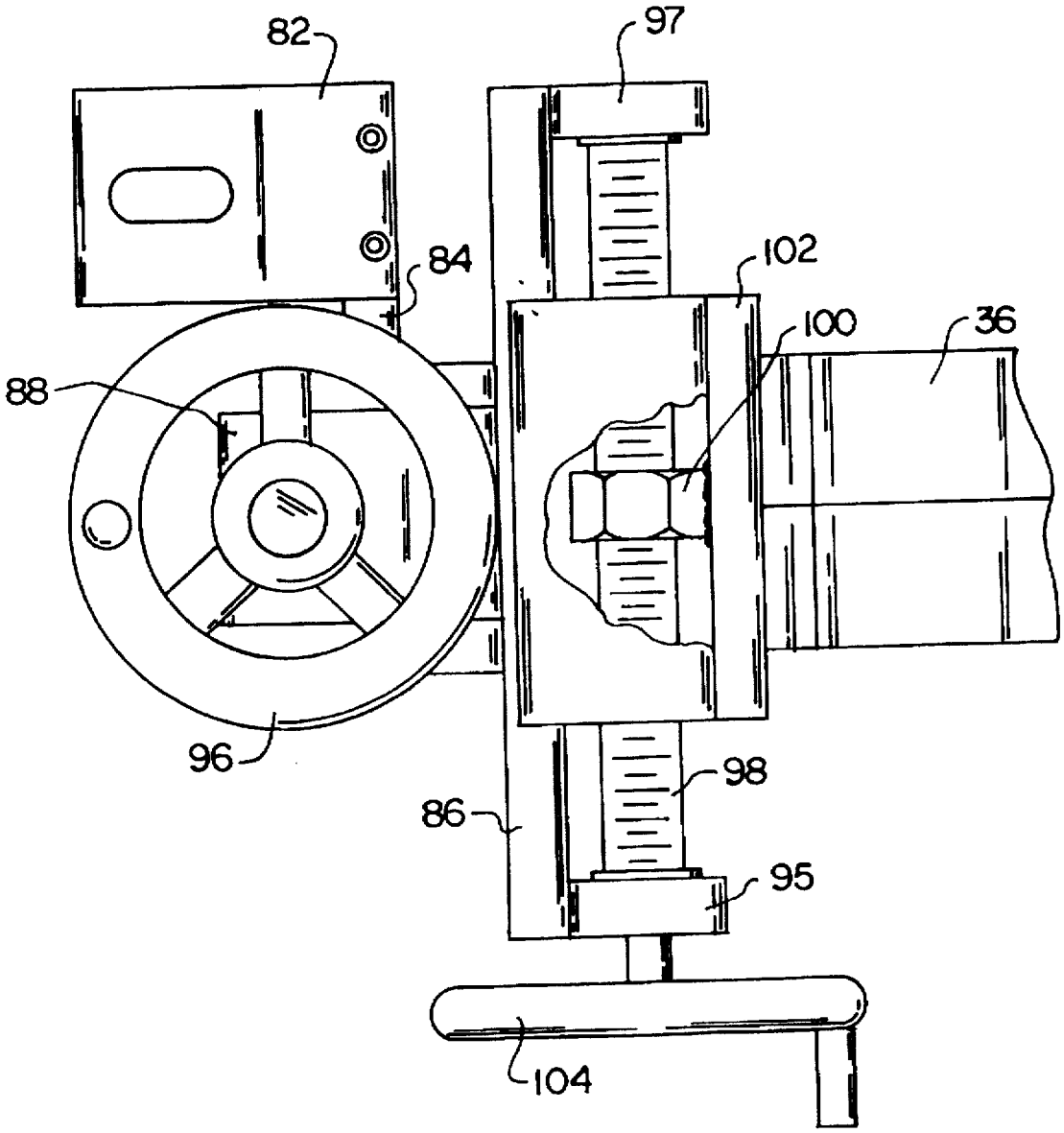
FIG. 4 is a plan view of a portion of the wrinkler of FIG. 2.
Figure 5:
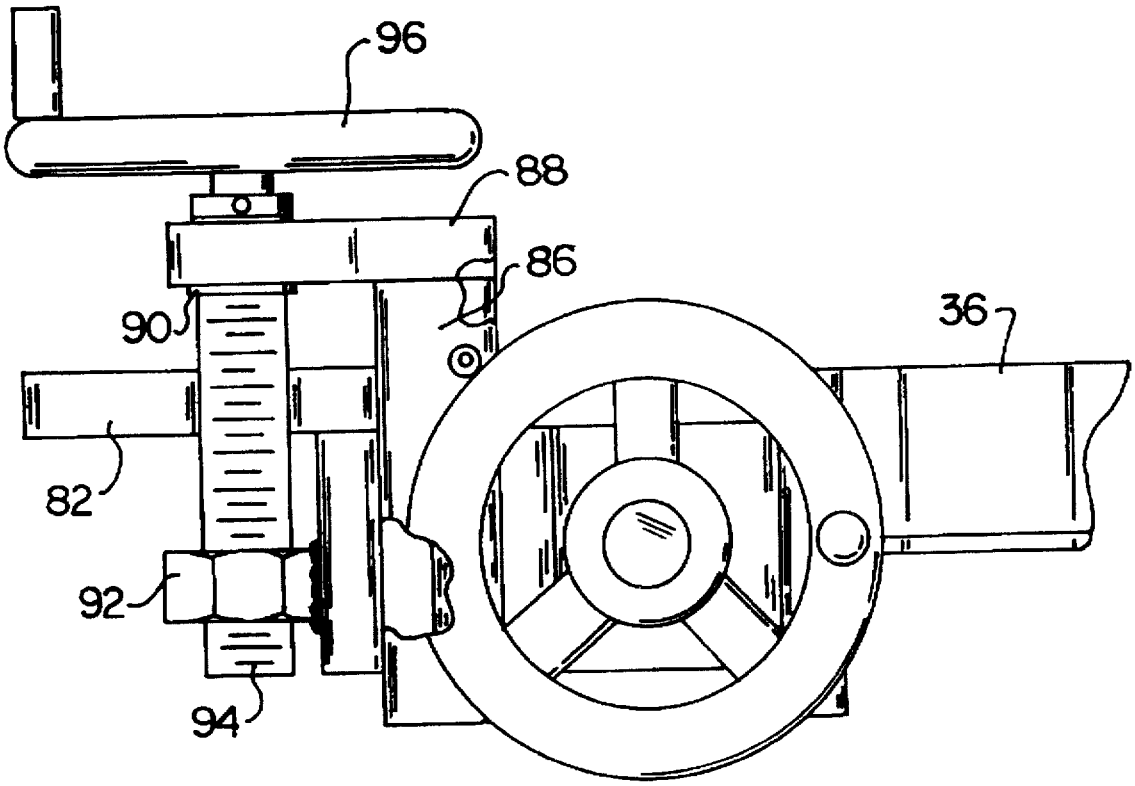
FIG. 5 is a side elevation view of the portion of the wrinkler shown in FIG. 4.

FIGS. 4 and 5 illustrate the means for adjusting skew and height at the left side of the bar 36 in FIG. 3. The right side apparatus is the mirror image. A flange 82 is configured with a hole to cooperate with a mounting platform on the printing apparatus adapted to receive a bolt to bolt the flange to the platform. A bar 64 is bolted to flange 82 and has nut 92 welded to it. Housing 86 is capped by plate 88 which has a bearing 90 formed therein aligned with the threaded portion of nut 92. A threaded shaft 94 is threaded into nut 92 and supports plate 88 and housing 86 by bearing 90. A crank wheel 96 is fixed on shaft 94 to allow the shaft 94 to be turned. As seen in FIG. 4, housing 86 includes endpiece 95 and endpiece 97, each with a bearing to receive threaded shaft 98, which is in turn threaded into nut 100. Nut 100 is welded to bar 36 and covered by cap 102. A crank wheel 104 is fixed on shaft 98.

Thus, when the crank wheel 96 is turned, the housing 86 and parts fixed to it, including the bar 36, will move up or down, depending on the direction of rotation. When the crank wheel 104 is turned, the bar 36 will move to the right or left in FIG. 2, depending on the direction of rotation. Thus the crank wheels may be used to vary the amount of pressure that the neoprene strip 76 exerts on a passing fabric.

Figure 6:
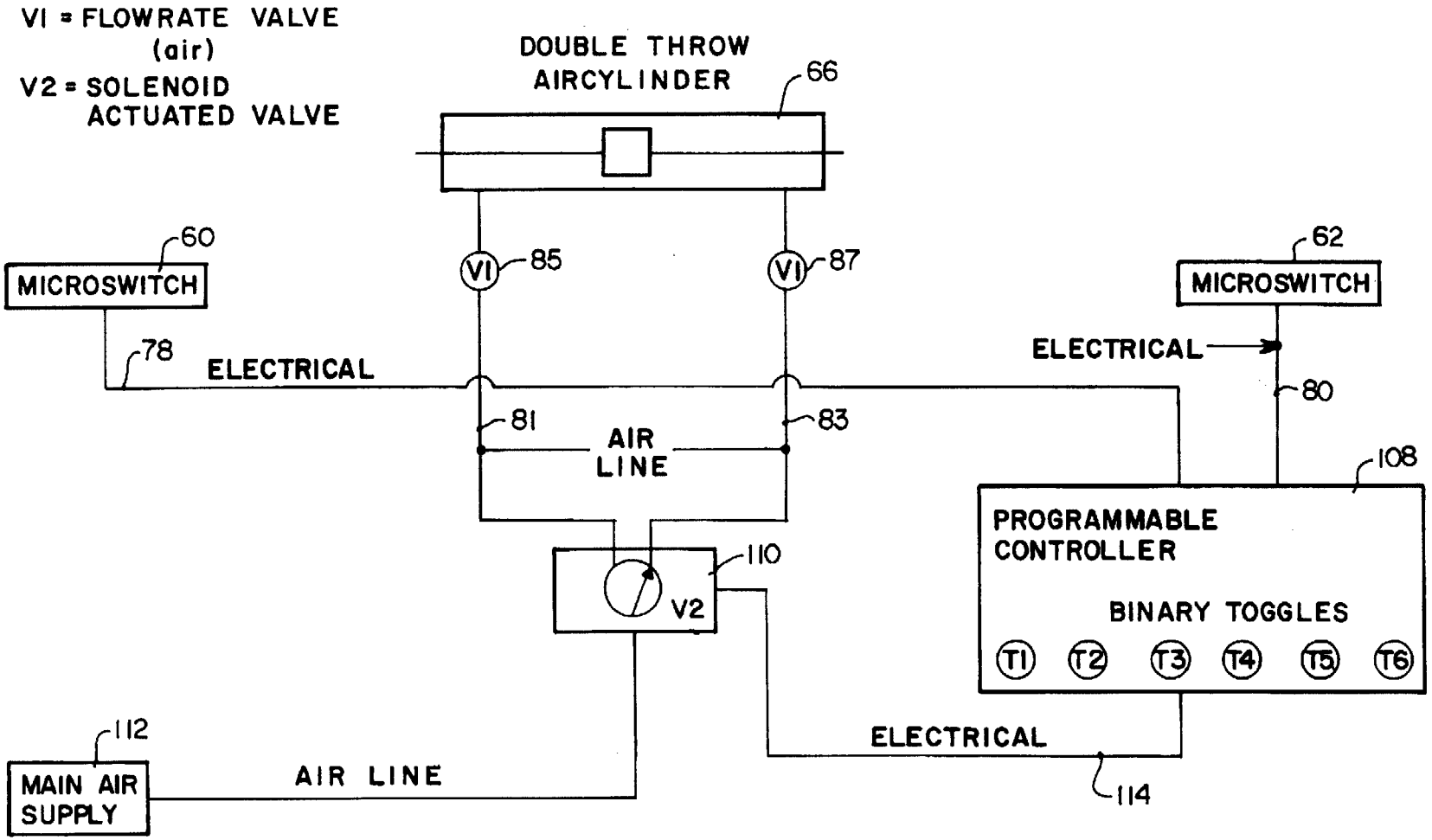
FIG. 6 is a schematic drawing of the electrical ad pneumatic components of the embodiment of FIG. 2.

FIG. 6 illustrates the electrical and pneumatic connections for the wrinkler embodiment shown in FIGS. 1–5. The apparatus includes programmable controller 108, solenoid-operated air valve 110 and main air supply 112. The controller 108 gets inputs from limit switches 60 and 62 via lines 78 and 80. As will be apparent, these signals, which are indicative of full travel of moveable bar 54, can be electrical or pneumatic, as desired. Controller 108 outputs its control signals on line 114 to the valve 110. The electrical signals on line 114 set valve 110 to pass air from main air supply 112 to either line 81 or line 83 or neither. Controller 108 is provided with six toggle switches T1–T6, each of which when selected inserts a preset delay in the restart of the traverse of bar 54. The switches can be selectively actuated in binary fashion to determine a desired delay period between traverses of moveable bar 54. Thus the controller could be fashioned to operate according to any of the following examples:

| Switch Period(sec) | T1 1 | T2 ½ | T3 ¼ | T4 ⅛ | T5 1/16 | T6 1/32 | Total Delay |
|---|---|---|---|---|---|---|---|
| Example 1 | N | N | N | Y | N | Y | 5/32 sec |
| Example 2 | N | Y | N | Y | Y | Y | 23/32 sec |
| Example 3 | Y | N | N | N | Y | N | 17/16 sec |
| Example 4 | Y | Y | Y | Y | Y | Y | 63/32 sec |

Upon receiving a signal from either of switches 60 or 62, the controller 108 actuates valve 110 to cut off the supply of air to the cylinder 66 and begins the selected delay period. At the expiration of the delay period, controller 108 actuates valve 110 to supply air to the line of the side of cylinder 66 not last used. Valves 85 and 87 are adjustable flow rate valves to permit the rate of air flow into cylinder 66 to be controlled and thereby control the rate of movement of bar 54. As will be apparent, the valves 85 and 87 may be equally or unequally set to achieve different results, as desired.

Figure 12:
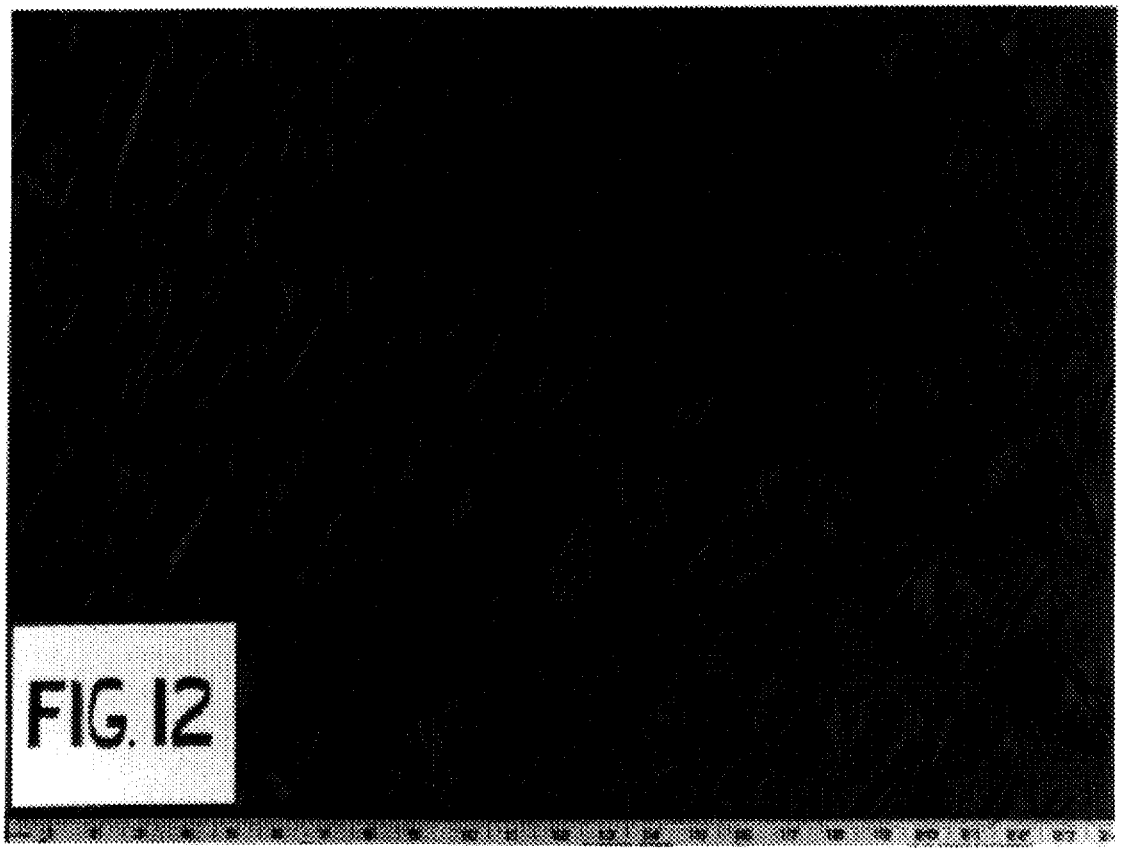
FIG. 12 is photograph of a single color wrinkled fabric according to an embodiment of the invention.
Figure 13:
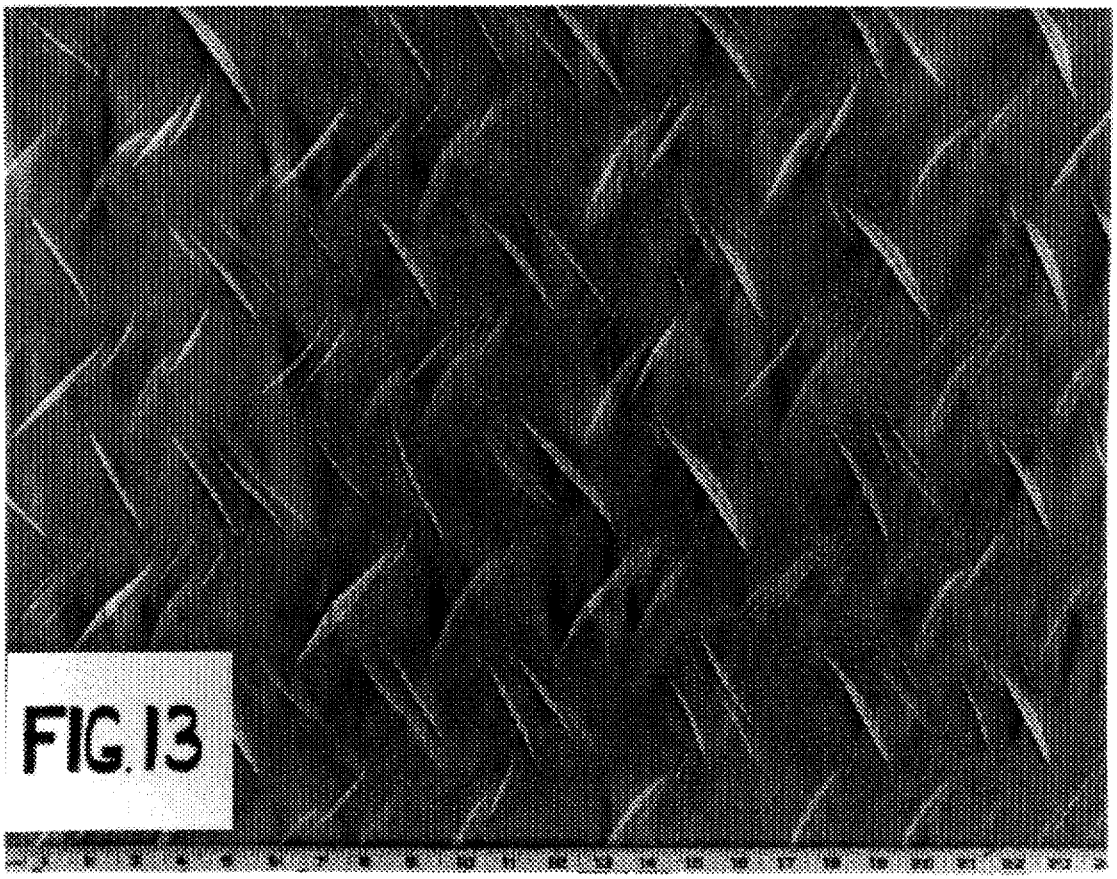
FIG. 13 is a photograph of a multi-color wrinkled fabric according to an embodiment of the invention.

In operation, the fabric to be treated is fed into the apparatus as shown in FIG. 1, under the neoprene strip 76 of the bar 54 and along the path shown in FIG. 1. Downstream of the wrinkler 34 a paper 28 having a solid dye or a print pattern may be put into contact with the fabric, or not, as desired. The wrinkler is put into motion by supplying air to the cylinder 66 via the valve 110 under the control of programmable controller 108 and operator-controlled adjustments to valves 85 and 87. As the fabric is drawn through the machine in the warp direction of the fabric by the take-up mechanism, the side to side moving neoprene strip grips the fabric and carries it in the direction of sideways movement (i.e. the fabric weft direction). This movement is resisted by the tension on the fabric, resulting in the localized buildup of forces in the fabric. When the forces build to exceed the frictional grip of the neoprene on the fabric, the fabric slips, moving in the direction of main fabric movement (i.e. the warp direction of the fabric). The loosely bound lower strip 76 moves somewhat with the fabric, providing an element of motion not otherwise available, but desirable in achieving aesthetic effects. The result is the formation of wrinkles in the fabric, with the wrinkles formed in an undulatory pattern, due to the combination of the back-and-forth motion of the bar 54 and the continuous through put motion of the fabric drawn by the takeup mechanism. The resulting fabric desirably has an appearance similar to that shown in FIG. 12 when no print paper is used or similar to that shown in FIG. 13 when print paper is used. As can be seen, the wrinkles are formed at angles to the fabric edges, with overall warpwise extending undulations. The wrinkles extend for short lengths and alternate between angles toward one side edge and the other.

When a transfer print paper is used in the invention, the paper is preferably applied just downstream of the wrinkler and upstream of the heated roll 24, so that the wrinkles have already been formed in the fabric before the paper is applied. The wrinkles result in portions of the fabric obscuring other portions of the fabric, so that the obscured portions do not receive dye from the paper and stay their original color. Thus, the decorative effect of the undulatory wrinkles is enhanced by creating the print pattern on the fabric. The heat transfer printing could, if desired, be carried out as a separate step before or after the setting of the wrinkles in the fabric. Other suitable dyeing or printing operations could also be used, with the doctoring of a foam or print paste possible likely choices.

Figure 7:
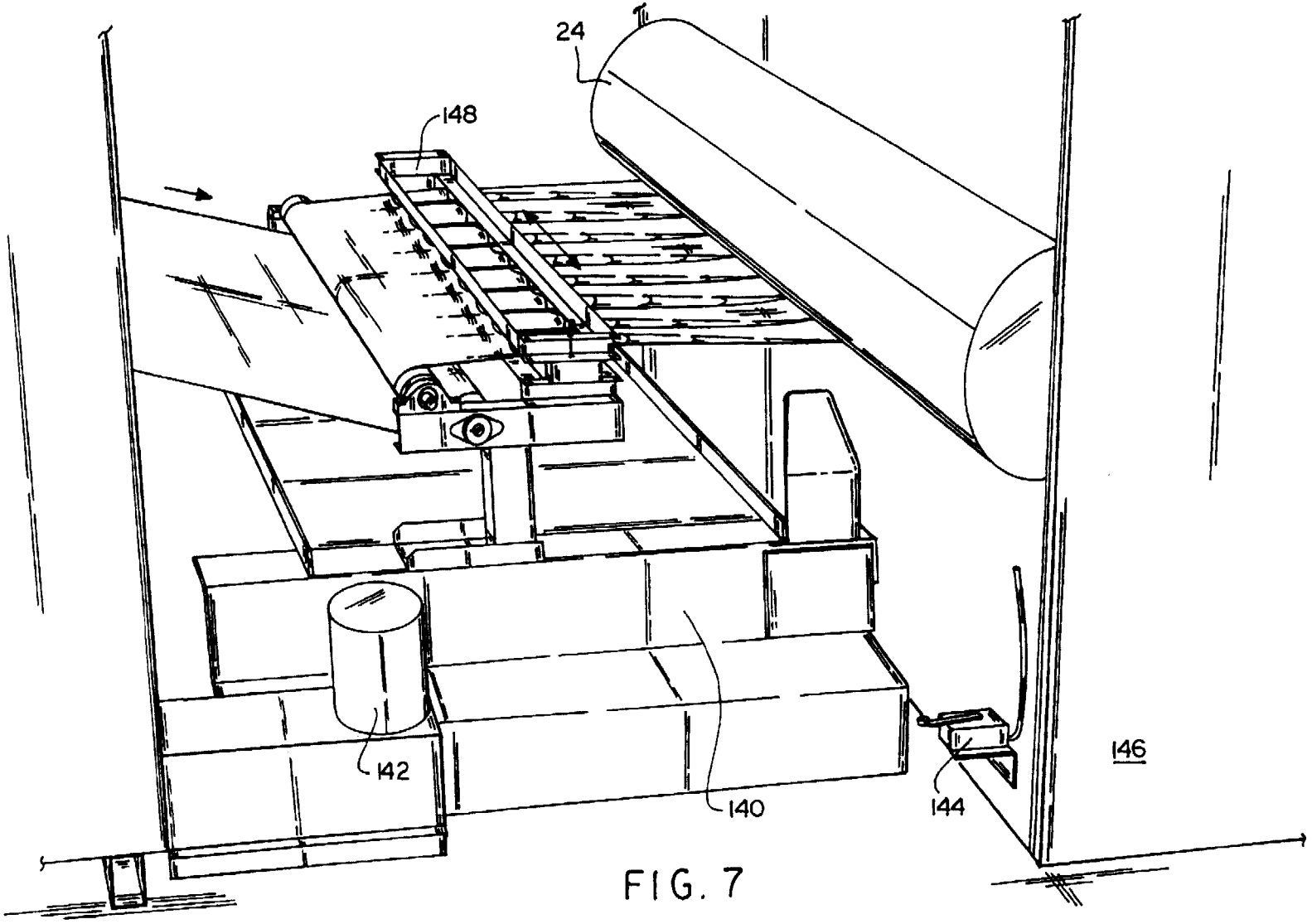
FIG. 7 is a perspective view of a transfer printing apparatus modified according to a second embodiment of the invention.
Figure 8:
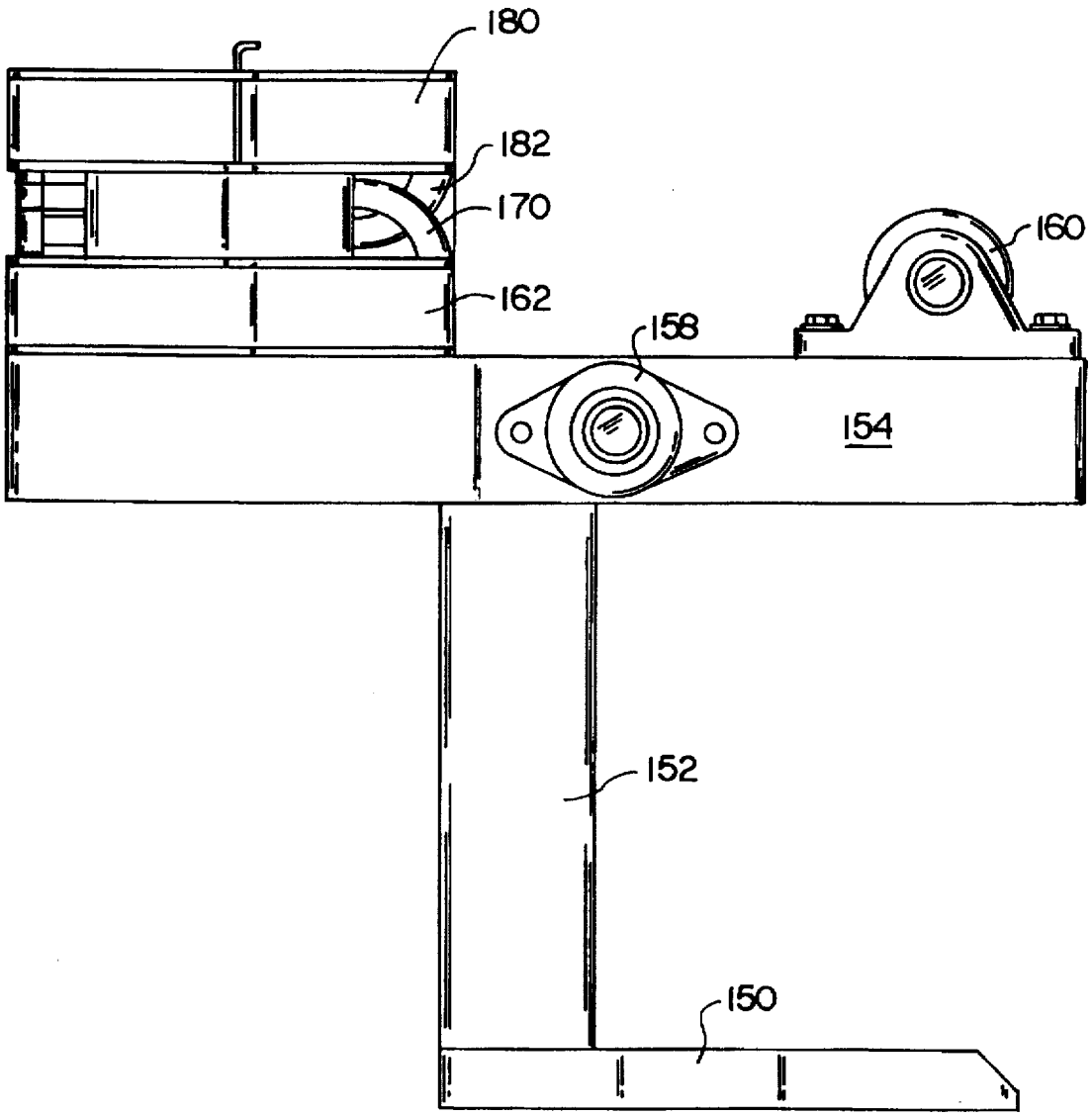
FIG. 8 is a side elevation view of the wrinkler of FIG. 7.
Figure 9:
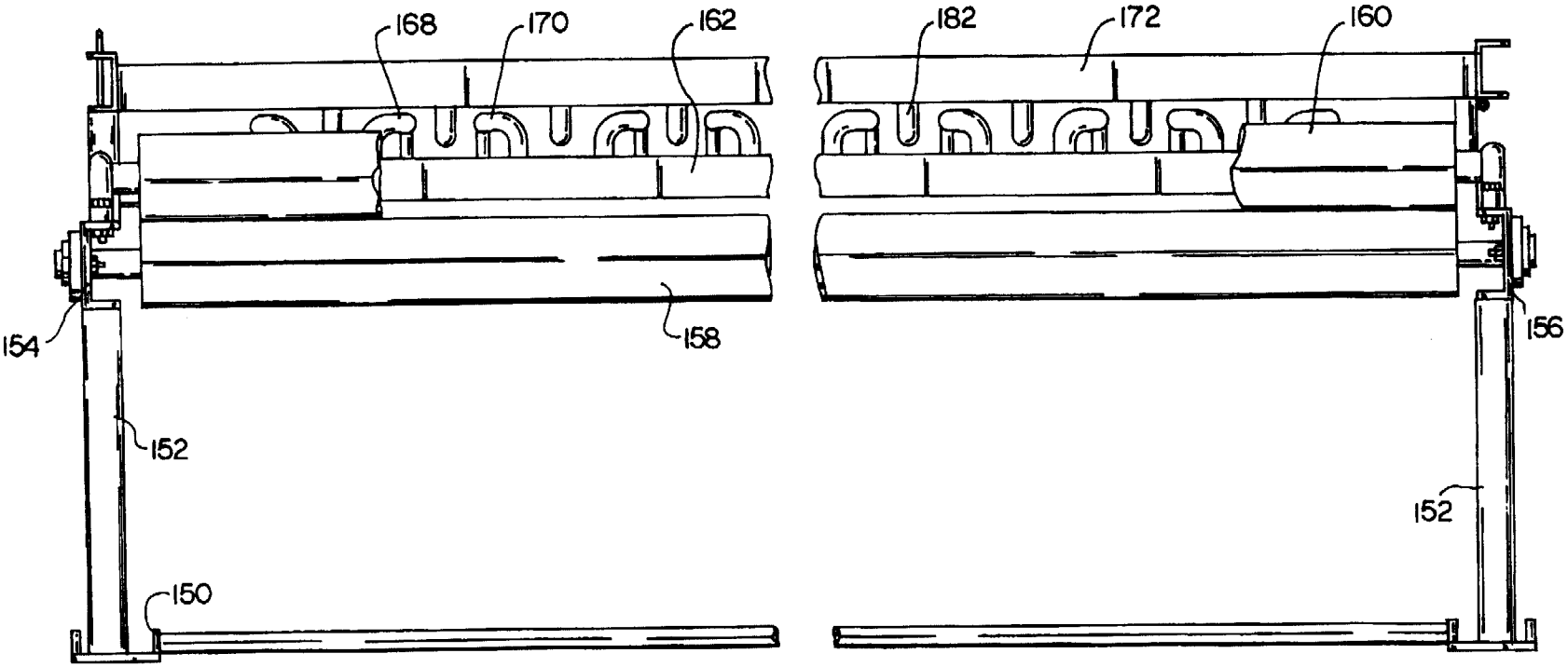
FIG. 9 is front elevation view of the wrinkler of FIG. 7.
Figure 11:
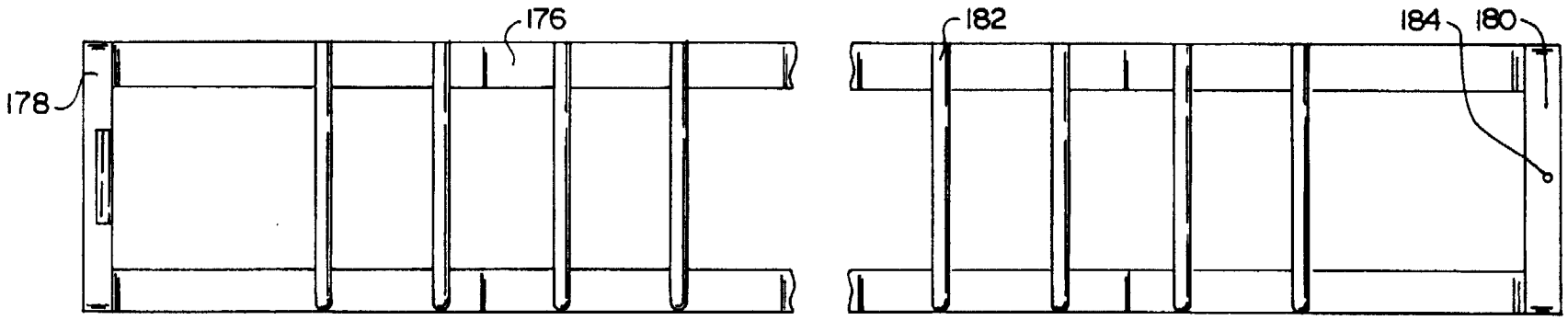
FIG. 11 is a bottom view of the top portion of the wrinkler of FIG. 7.
Figure 10:
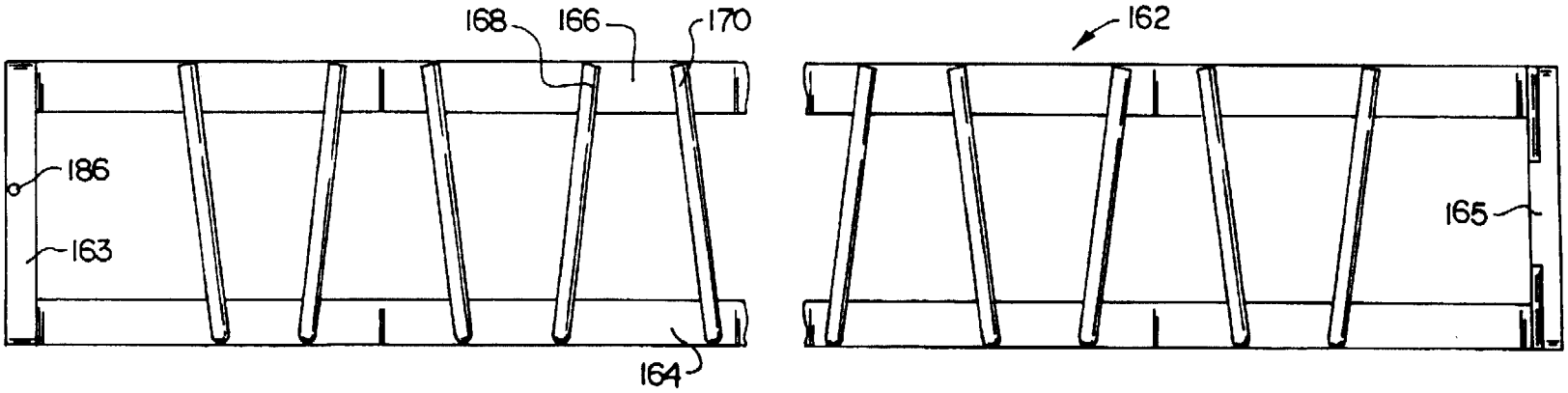
FIG. 10 is a plan view of the bottom portion of the wrinkler of FIG. 7.

An alternative embodiment of apparatus useful in making the fabric and in practicing the process of the invention is shown in FIGS. 7–11. The apparatus shown in FIG. 7 is a modification of a standard transfer printing apparatus. The standard apparatus comes with preparation platform 140 which is mounted for side-to side movement by motor drive 142. The transfer printing machinery manufacturer provides such a platform so that the print paper and fabric can be aligned when being fed into conventional operation. Applicant has modified this arrangement by adding limit switches 144 on either side of the printer housing 146 to provide a signal to a programmable controller. Operation of the programmable controller and the limit switches for this embodiment is completely analogous to the operation described in connection with FIG. 6, A different wrinkler 148 is used in this embodiment, shown mounted on the platform 140. This wrinkler, which acts to impart wrinkles or folds in the fabric, can be better seen in FIGS. 8–11. The wrinkler includes a pair of feet 150 and uprights 152, which support beams 154, 156. A median roller 158 is journaled in bearings in the beams 154, 156, and a rear roller 160 is journaled in bearings on top of the beams 154, 156. Beams 154, 156 support a cross-machine extending lower finger array 162, seen in plan view in FIG. 10. The array 162 includes angle irons 164 and 166, endpieces 163 and 165, and a plurality of fingers 168 and 170 extending upward from the angle irons 164 and 166 and spanning the gap therebetween. The fingers extend slightly above the level of the top of the rear roller 160. As is best seen in FIG. 10 the fingers 168 slant to the right slightly from the machine direction. A preferred angle is 7 degrees. Intermediate fingers 168 are fingers 170 slanted a similar angle to the left.

An upper finger array 172 has similar angle irons 174 and 176, endpieces 178 and 180, and fingers 182. Endpiece 178 is hinged to endpiece 165 and endpieces 180 and 163 may be pinned together by a pin through holes 184 and 186 when the upper array is lowered onto the lower array. The fingers 182 extend downwardly from angle iron 174 to a level below the top of the rear roller 160 and alternate with fingers 168 and 170, as shown in FIG. 9.

In operation, the finger arrays 162 and 172 are separated by unpinning the endpieces 163 and 180 lifting the upper array about the hinge on endpieces 165 and 178. Fabric to be treated is fed from the fabric supply under and around roller 158, back under and around roller 160 and between the opened arrays. The arrays are brought together and repinned. The interleaving of the finger arrays, shown in FIG. 9, with the lower portions of upper fingers 182 extending below the upper portions of lower fingers 168 and 170 causes the fabric to assume a pleated or folded configuration. The leading end of the fabric is then fed against roll 24 (with or without transfer paper, as desired) and the fabric is fed continuously through the apparatus, with the platform 140 oscillating from side to side under the control of the programmable controller.

As the platform moves to one side, the pleats or folds in the fabric made by the interleaved fingers become wrinkles extending generally in the machine direction, but oblique to the warp and weft, due to the interaction of the side to side motion of the platform and the forward motion of the fabric. In addition, the angled orientation of the fingers 168, 170 adds further angularity variables in the patterns of the folds and wrinkles. The result is a fabric similar to the fabric shown in FIGS. 12 and 13, but generally with longer folds and a somewhat longer "wavelength" to the undulations, giving rise to a pattern reminiscent of bamboo leaves.

A particularly preferred fabric for use in the invention is a chintz made of polyester, but any fabric of suitable heat settable fibers may be used, including polyester, nylon, olefin, and acrylic or blends thereof, which may include cotton, wool and rayon.

Additional embodiments of the fabric of the invention can be seen in FIGS. 14 and 15. In each of these embodiments, the wrinkles are developed in the fabric in a process preceding the transfer printing step. Thus, each fabric is first made by feeding it to a stitching machine, such as a Cidega machine, typically with overfeed. Other stitching machines such as quilting machines, flatbed knitting machines, and the like may be suitable. The fabric is fed into the stitching area of the machine with overfeed, so that excess fabric enters the stitching area and results in the formation of wrinkles when the dimensions of the fabric are established by the stitches. (However, overfeed may not be necessary in every case. The stitching thread may shrink differently from the fabric when exposed to the heat setting temperature and thereby form the desired pucker or wrinkle.) As will be apparent, if the fabric is fed in the warp direction, which is most convenient, the wrinkles formed extend generally weft-wise. The exact orientation of the wrinkles in the fabric will be determined by the angle of approach of the fabric to the needles. Other ways of feeding the fabric to the needles to result in forming wrinkles in the fabric may be used.

The needles may be programmed conventionally to stitch any desired pattern in the fabric. Typically, the pattern will be selected for aesthetic qualities because it will be apparent in the finished product.

The fabric as so stitched is then supplied to a transfer printing machine along with the heat transfer paper in conventional fashion. The procedure shown in FIG. 1, absent the inclusion of the oscillator, is quite satisfactory. As the fabric, with its wrinkles and the transfer paper, enter the nip of the printing apparatus, printing and heat-setting take place in conventional fashion. The printing may be with a solid color, but a pattern is preferred. However, since the fabric has been pre-stitched with the resultant formation of wrinkles in the fabric, the pattern printed on the fabric is modified from the pattern apparent on the print paper. The raised portions of the stitching and the raised portion of the wrinkles take up the color more than the surrounding areas, so that the printed pattern on the transfer paper is modified by the presence of the stitching and the wrinkles. These modifications provide a new and aesthetically desirable look. Two examples of resulting fabrics are seen in the photographs of FIGS. 14, 14A, 15 and 15A.

In each of these fabrics, the wrinkles tend to extend from one area of stitching to another, typically with a substantial weft-wise direction. As can be seen in FIG. 14, the stitching is provided in a rectangular grid pattern and within the rectangular grid, the fabric is somewhat puckered to again provide modified pickup of the dyestuff from the transfer print.

The wrinkling can be somewhat accentuated in the heat transfer process by virtue of a 2% shrinkage of the fabric to introduce further puckering to the fabric.

In FIG. 15, the stitching is less concentrated, permitting the wrinkles to extend a substantial distance from one stitch portion to another and introducing a moire look to the solid areas of the color of the printed pattern.

If desired, the fabric may be dyed before stitching, to add further interest, and, in fact, this was done with the fabrics of FIGS. 14 and 15.

As will be apparent, a wide variety of print patterns can be used, a wide variety of stitch patterns can be used, and the degree of overfeed to the stitch patterns can be varied as desired to accentuate or minimize the wrinkle look. If desired, the stitching and print pattern can be in registration or otherwise coordinated to complement each other predictably. Alternatively, the interaction can be more random.

The fibers usable with this embodiment of the invention are the same as those for the embodiment of FIGS. 1–13.

Several particularly preferred embodiments of the invention have been discussed above, but the scope of the invention includes a wide variety of variables, so that the above-described embodiments should be considered to be exemplary only and not limiting.

What is claimed is:

1. A fabric having warp and weft directions and having wrinkles heat set therein in which the wrinkles are oriented oblique to the warp and weft directions and form a warpwise extending undulation.

2. A fabric as claimed in claim 1 wherein the fabric has side edges and the wrinkles extend for short lengths and alternate ones of the wrinkles form angles toward one side edge and interspersed ones of the wrinkles form angles toward the other side.

3. A fabric as claimed in claim 1 wherein the fabric is chintz.

4. A fabric as claimed in claim 1 wherein the fabric is made of a heat settable fiber.

5. A fabric as claimed in claim 1 wherein the fabric is made of a fiber selected from the group consisting of polyester, nylon, olefin, acrylic and blends thereof.

6. A fabric having warp and weft directions and wrinkles therein oriented oblique to the warp and weft directions to form portions obscured by folds and coloration on the fabric in areas other than the obscured portions.

7. A fabric as claimed in claim 6 wherein the fabric has side edges and the wrinkles extend for short lengths and alternate ones of the wrinkles form angles toward one side edge and interspersed ones of the wrinkles form angles toward the other side.

8. A fabric as claimed in claim 6 wherein the wrinkles in the fabric form a warpwise extending undulation.

9. A fabric as claimed in claim 6 wherein the fabric is chintz.

10. A fabric as claimed in claim 6 wherein the fabric is made of a heat settable fiber.

11. A fabric as claimed in claim 6 wherein the fabric is made of a fiber selected from the group consisting of polyester, nylon, olefin, acrylic and blends thereof.

12. A fabric as claimed in claim 6 wherein the fabric has two faces and the coloration is predominantly on one face.

13. A fabric as claimed in claim 6 wherein the coloration is fixed onto the fabric.

14. A fabric as claimed in claim 6 wherein the coloration is a transfer print.

15. A fabric as claimed in claim 6 wherein the coloration is a pattern.

16. A fabric as claimed in claim 6 wherein the fabric is woven.

17. A fabric having warp and weft directions and side edges, wrinkles therein extending for short lengths, alternate ones of the wrinkles forming angles toward one side edge and interspersed ones of the wrinkles forming angles toward the other side to form a warpwise extending undulation so that portions of the fabric are obscured by folds, and transfer print coloration on the fabric in areas other than the obscured portions.

18. A fabric having warp and weft directions and wrinkles heat set therein in which the wrinkles are oriented oblique to the warp and weft directions and form a weftwise extending undulation.

19. A fabric as claimed in claim 18 wherein the fabric has a plurality of stitched portions and the wrinkles extend from one stitched portion to another.

20. A fabric as claimed in claim 18 wherein the fabric is chintz.

21. A fabric as claimed in claim 18 wherein the fabric is made of a heat settable fiber.

22. A fabric as claimed in claim 18 wherein the fabric is made of a fiber selected from the group consisting of polyester, nylon, olefin, and acrylic or blends thereof.

23. A fabric having warp and weft directions and having wrinkles therein oriented oblique to the warp and weft directions and areas between said wrinkles and coloration on the fabric extending across said wrinkles, with the wrinkles having coloration of a deeper hue than the areas of the fabric between said wrinkles wherein the fabric has a plurality of stitched portions and the wrinkles extend from one stitched portion to another.

24. A fabric as claimed in claim 23 wherein the stitching is provided in a pattern.

25. A fabric as claimed in claim 24 colored with a colored pattern wherein the stitching and the wrinkles combine to form a pattern on the fabric different from the stitched or colored patterns alone.

26. A fabric having warp and weft directions and having wrinkles therein oriented oblique to the warp and weft directions and areas between said wrinkles and coloration on the fabric extending across said wrinkles with the wrinkles having coloration of a deeper hue than the areas of the fabric between said wrinkles wherein the coloration is provided in a pattern, and the deeper hue of color in the wrinkles modifies the pattern.

27. A fabric having warp and weft directions and having wrinkles therein oriented oblique to the warp and weft directions and areas between said wrinkles and coloration on the fabric extending across said wrinkles, with the wrinkles having coloration of a deeper hue than the areas of the fabric between said wrinkles wherein the fabric has stitching provided in a first pattern forming stitched fabric portions and the wrinkles extend from one stitched portion to another, the coloration is provided in a second pattern, and the deeper hue of color in the wrinkles modifies the second pattern.

28. A fabric as claimed in claim 27 wherein the fabric is chintz.

29. A fabric as claimed in claim 24 wherein the fabric is made of a heat settable fiber.

30. A fabric having warp and weft directions and having wrinkles therein oriented oblique to the warp and weft directions and areas between said wrinkles and coloration on the fabric extending across said wrinkles, with the wrinkles having coloration of a deeper hue than the areas of the fabric between said wrinkles wherein the fabric has a stitched portion and at least some of the stitched portion has a coloration of a deeper hue than the areas of fabric between said wrinkles.

31. A fabric as claimed in claim 30 wherein the fabric has warp and weft directions and the wrinkles are oblique to the warp and weft direction.

32. A fabric as claimed in claim 30 wherein the fabric has two faces and the coloration is predominantly on one face.

33. A fabric as claimed in claim 30 wherein the coloration is fixed onto the fabric.

34. A fabric as claimed in claim 30 wherein the coloration is a transfer print.

35. A fabric as claimed in claim 30 wherein the fabric is woven.

36. A chintz fabric having a plurality of stitched portions with stitching provided in a pattern, wrinkles extending from one stitched portion to another, fabric areas between said wrinkles, and transfer printed coloration on the fabric provided in a pattern extending across said wrinkles and said fabric areas, with said wrinkles and at least some of said stitched portions having coloration of a deeper hue than the areas of the fabric between said wrinkles so that the deeper hue of color in said wrinkles and stitched portions modifies the pattern of the coloration and the stitching and the wrinkles combine to form a new pattern on the fabric.

* * * * *